United States Patent [19]

Lamatrice

[11] Patent Number: 4,964,428

[45] Date of Patent: Oct. 23, 1990

[54] ARTIFICIAL EYEBROW CONSTRUCTION

[76] Inventor: Barbara A. Lamatrice, 3215 Chemehueui Blvd., Lake Havasu, Ariz. 86403

[21] Appl. No.: 413,204

[22] Filed: Sep. 27, 1989

[51] Int. Cl.[5] ..... A45D 40/30

[52] U.S. Cl. ..... 132/216; 132/53; 132/56

[58] Field of Search ..... 132/53, 56, 201, 212, 132/215, 216; 446/100, 393, 394

[56] References Cited

U.S. PATENT DOCUMENTS

| | | | |
|---|---|---|---|
| 1,042,972 | 10/1912 | Ronshkowsky | 132/53 |
| 2,001,589 | 5/1935 | Steiner | 132/53 |
| 2,814,301 | 11/1957 | Schmitz | 132/56 |
| 2,842,142 | 7/1958 | Peck | 132/216 |
| 3,823,723 | 7/1974 | Miller | 132/201 |
| 3,833,007 | 9/1974 | Jacobs | 132/53 |
| 3,862,638 | 1/1975 | Fannin | 132/53 |
| 3,880,175 | 4/1975 | Hosokawa | 132/53 |
| 4,024,879 | 5/1977 | Stryker | 132/216 |
| 4,029,111 | 6/1977 | Barton | 132/53 |
| 4,029,112 | 6/1977 | Boose | 132/315 |
| 4,296,765 | 10/1981 | Bachtell | 132/53 |
| 4,299,242 | 11/1981 | Choe | 132/53 |

*Primary Examiner*—John J. Wilson
*Assistant Examiner*—Frank A. Laviola, Jr.
*Attorney, Agent, or Firm*—Leon Gilden

[57] ABSTRACT

An artificial eyebrow is set forth wherein a flexible, polymeric membrane includes a matrix of human hair filaments adhesively mounted about rows of base filaments in staggered array to simulate human spacing of hair follicles. The membrane includes an adhesive base with a peel-away strip mounted thereon. The degree of fullness of the eyebrow may be effected by utilizing alternating rows of varying thickness hair follicles mounted to the base filaments.

1 Claim, 1 Drawing Sheet

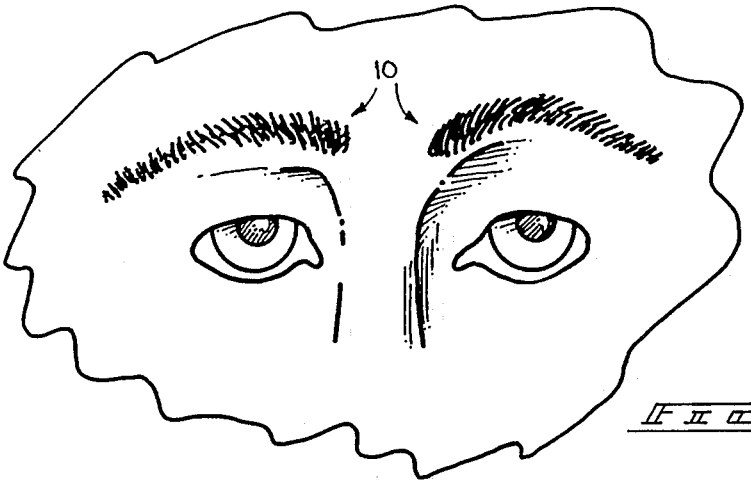
FIG 1
FIG 2
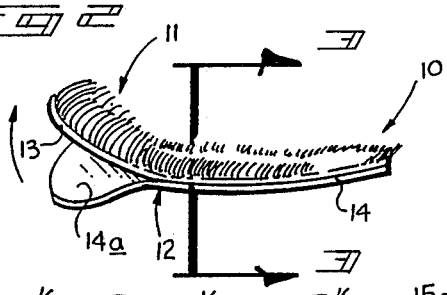
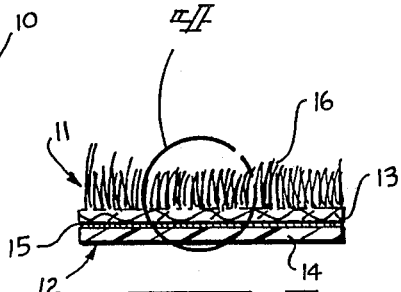
FIG 3
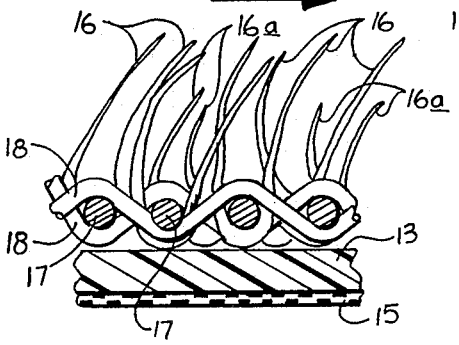
FIG 4
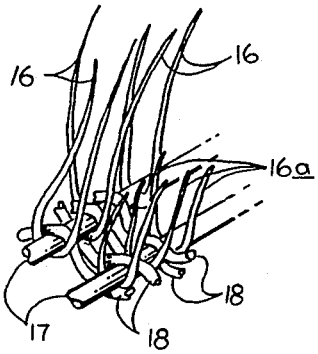
FIG 5

ARTIFICIAL EYEBROW CONSTRUCTION

BACKGROUND OF THE INVENTION

1. Field of the Invention

The field of invention relates to artificial eyebrows, and more particularly pertains a new and improved artificial eyebrow construction wherein the same is selectively and adherably mounted to an individual's forehead to simulate a natural eyebrow.

2. Description of the Prior Art

The prior art has utilized various hair portions to simulate and replace lost portions occurring due to illness, accident or injury. The replacement hair portions of the prior art have heretofore failed to simulate in a quick and easily adherable fashion an individual's eyebrow to the forehead portion. Examples of the prior art include U.S. Pat. No. 4,029,111 to Barton wherein the same utilizes an artificial eyebrow including a group of natural or artificial hair filaments connected together for securement to an eyelid.

U.S. Pat. No. 4,029,112 to Boose sets forth a mustache replacement including a mustache container with the mustache provided with an adhesive surface.

U.S. Pat. No. 3,833,007 to Jacobs sets forth an artificial eyebrow construction utilizing a plurality of single feathered lashes secured by various mechanical means to support filaments.

U.S. Pat. No. 3,880,175 to Hosokawa sets forth a false eyelash construction utilizing hair units mounted on a supporting grid bonded to a plastic film for securement to the eyelid.

U.S. Pat. No. 4,299,242 to Choe sets forth a method of making artificial eyelashes, including knotting eyelashes to support filaments.

As such, it may be appreciated that there is a continuing need for a new and improved artificial eyebrow construction wherein the same addresses both the problems of ease of use and effectiveness in construction to provide an artificial eyebrow configuration conforming to natural curvature of a human forehead and simulating human hair follicle density patterns.

SUMMARY OF THE INVENTION

In view of the foregoing disadvantages inherent in the known types of artificial hair replacement constructions now present in the prior art, the present invention provides an artificial eyebrow construction wherein the same is selectively and readily mounted to a human forehead overlying an associated eye. As such, the general purpose of the present invention, which will be described subsequently in greater detail, is to provide a new and improved artificial eyebrow construction which has all the advantages of the prior art artificial hair replacement portions and none of the disadvantages.

To attain this, the artificial eyebrow construction of the instant invention includes a matrix of human hair portions mounted to rows of base hair filaments wherein the human hair portions are of varying densities from row to row and of offset positioning to simulate appropriate density patterns of human eyebrow construction, wherein the rows and columns of hair portions are mounted to a flexible, polymeric membrane adherable and readily conformable to a human forehead adjacent an overlying and associated eye.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved artificial eyebrow construction which has all the advantages of the prior art artificial hair replacement assemblies and none of the disadvantages.

It is another object of the present invention to provide a new and improved artificial eyebrow construction which may be easily and efficiently manufactured and marketed.

It is a further object of the present invention to provide a new and improved artificial eyebrow construction which is of a durable and reliable construction.

An even further object of the present invention is to provide a new and improved artificial eyebrow construction which is susceptible of a low cost of manufacture with regard to both materials and labor, and which accordingly is then susceptible of low prices of sale to the consuming public, thereby making such artificial eyebrow constructions economically available to the buying public.

Still yet another object of the present invention is to provide a new and improved artificial eyebrow construction which provides in the apparatuses and methods of the prior art some of the advantages thereof, while simultaneously overcoming some of the disadvantages normally associated therewith.

Still another object of the present invention is to provide a new and improved artificial eyebrow construction wherein the same is readily and selectively mounted to a forehead portion overlying respective eyes to simulate arcuate eyebrow configurations.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic view taken in elevation of the artificial eyebrow construction positioned on a human face.

FIG. 2 is an isometric illustration of the artificial eyebrow of the instant invention.

FIG. 3 is an orthographic view taken along the lines 3—3 of FIG. 2 in the direction indicated by the arrows.

FIG. 4 is an orthographic view, somewhat expanded, of Section 4 as set forth in FIG. 3.

FIG. 5 is a diagrammatic illustration of the rows and columns of human hair portions utilized by the instant invention.

DESCRIPTION OF THE PREFERRED EMBODIMENT

With reference now to the drawings, and in particular to FIGS. 1 to 5 thereof, a new and improved artificial eyebrow construction embodying the principles and concepts of the present invention and generally designated by the reference numeral 10 will be described.

More specifically, the artificial eyebrow construction 10 of the instant invention essentially comprises a human hair eyebrow matrix 11 formed of a series of "U" shaped human hair follicles 16 and **16*a* mounted in a looped relationship underlying a series of longitudinally aligned first base filaments 17 defining horizontal rows, with the filaments 16 and 16*a* offset relative to one another between adjacent rows to define vertical rows 18. The vertical rows 18 include hair filaments to overlie a thin, flexible polymeric support membrane 13 and mounted thereon, wherein the base filaments 17 and 18 are of human hair construction to enhance simulation of the artificial eyebrow construction 10. The support membrane 13 includes an adhesive layer 15 laminated on the bottom surface thereon with a polymeric backing surface of a configuration complementary to that of the support membrane 13, with a finger grasping tab 14*a* extending exteriorly and in the same plane as the backing surface 14 to define the polymeric removal strip 12, as illustrated in FIGS. 2 and 3. As noted, the filaments 16 and 16*a* are of varying thicknesses, with the filaments 16 preferably being of a thicker filament cross-sectional configuration of that of 16*a*. To provide an enhanced bushy appearance to the eyebrow, the filaments 16 and 16*a*** may alternatively be of similar thickness or cross-sectional configuration.

As to the manner of usage and operation of the instant invention, an individual merely grasps the tab **14*a* to remove the backing surface 14 from the support membrane 13 to expose the adhesive layer 15. Subsequently the arcuate support membrane 13** is adhered to the forehead overlying an associated eye conforming to the natural curvature of the forehead portion.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An artificial eyebrow construction comprising, a flexible planar support membrane defining an arcuate perimeter, and securement means for mounting the support membrane onto a forehead surface of an individual, and a plurality of rows of base filaments directed longitudinally of the support membrane, and a matrix of eyebrow filaments secured to the base filaments, and wherein the flexible planar support membrane is formed of a thin, polymeric material, and wherein the securement means includes an adhesive laminated to a bottom surface of the support membrane, and further including a flexible, polymeric backing surface removably mounted to the adhesive, wherein the adhesive is defined as a laminated sheet coextensive with the bottom surface of the support membrane, and includes a finger grasping tab extending exteriorly of the backing surface formed in a single plane therewith, and wherein the base filaments are defined by elongate human hair filaments, and wherein the eyebrow filaments are defined by "U" shaped human hair filaments secured to each of the base filaments, and wherein each of the "U" shaped human hair filaments is offset relative to a "U" shaped hair filament in an adjoining row or human hair filaments secured to an adjacent base filament, and wherein "U" shaped human hair filaments of adjacent rows are of varying cross-sectional thickness.

* * * * *